US010787771B2

(12) United States Patent
Vargas et al.

(10) Patent No.: US 10,787,771 B2
(45) Date of Patent: Sep. 29, 2020

(54) RAIL VEHICLE HAVING STABILIZER WORKHEAD WITH POWERED AXLES

(71) Applicant: HARSCO TECHNOLOGIES LLC, Fairmont, MN (US)

(72) Inventors: Victor Vargas, West Columbia, SC (US); Syed Reza Sami, West Columbia, SC (US); Eric Carter, West Columbia, SC (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 342 days.

(21) Appl. No.: 15/666,872

(22) Filed: Aug. 2, 2017

(65) Prior Publication Data

US 2018/0038051 A1 Feb. 8, 2018

Related U.S. Application Data

(60) Provisional application No. 62/371,508, filed on Aug. 5, 2016.

(51) Int. Cl.
*E01B 27/20* (2006.01)
*E01B 33/02* (2006.01)

(52) U.S. Cl.
CPC ..... *E01B 27/20* (2013.01); *E01B 33/02* (2013.01); *E01B 2203/127* (2013.01)

(58) Field of Classification Search
CPC ..... E01B 27/20; E01B 27/12; E01B 27/13; E01B 27/16; E01B 27/17; E01B 2203/127; E01B 2203/148; E01B 33/02; B61C 9/42; B61C 9/48; B61C 9/50
USPC ..... 105/96.1, 96.2, 136; 104/2, 12
See application file for complete search history.

(56) References Cited

U.S. PATENT DOCUMENTS 3,019,742 A * 2/1962 Kershaw ..... B60F 1/043 105/72.2
5,113,767 A * 5/1992 Theurer ..... E01B 27/20 104/7.2
5,127,333 A * 7/1992 Theurer ..... E01B 27/20 104/12
5,172,635 A * 12/1992 Theurer ..... E01B 27/20 104/2

(Continued)

FOREIGN PATENT DOCUMENTS

JP 09-003803 A 1/1997
WO 2012-106077 A1 8/2012

OTHER PUBLICATIONS

An International Search Report and the Written Opinion of the International Searching Authority issued on Sep. 28, 2017 in connection with international patent Application PCT/US2017/045056.

*Primary Examiner* — Zachary L Kuhfuss
(74) *Attorney, Agent, or Firm* — Norton Rose Fulbright US LLP

(57) ABSTRACT

The present disclosure relates to a rail vehicle having a track stabilization unit for use in stabilizing rails into ballast. The rail vehicle comprises a frame and a track stabilization unit coupled to the frame. The track stabilization unit includes a base and a plurality of wheels disposed about the base. The wheels are configured to bias against rails of a railroad track. At least one of the wheels is coupled to a motor through a drive shaft such that rotation of the drive shaft drives rotation of the wheel. Related methods are described.

20 Claims, 7 Drawing Sheets

(56) References Cited

U.S. PATENT DOCUMENTS

| | | | | | |
|---|---|---|---|---|---|
| 5,172,637 | A * | 12/1992 | Theurer | E01B 27/20 | 104/7.2 |
| 5,257,579 | A * | 11/1993 | Theurer | E01B 35/00 | 104/2 |
| 5,617,794 | A * | 4/1997 | Theurer | E01B 27/20 | 104/7.2 |
| 5,887,527 | A * | 3/1999 | Theurer | E01B 27/20 | 104/7.2 |
| 8,186,070 | B2 * | 5/2012 | Theurer | E01B 35/08 | 33/338 |
| 8,505,459 | B2 * | 8/2013 | Miller | E01B 27/20 | 104/12 |
| 9,121,139 | B2 * | 9/2015 | Delucia | E01B 29/32 | |
| 9,982,396 | B2 * | 5/2018 | Lichtberger | E01B 27/20 | |
| 10,260,203 | B2 * | 4/2019 | Lintz | E01B 27/17 | |
| 2005/0217532 | A1 * | 10/2005 | Conneally | B60F 1/04 | 105/215.1 |
| 2011/0107938 | A1 | 5/2011 | Weidmann et al. | | |
| 2014/0013991 | A1 * | 1/2014 | Delucia | E01B 29/32 | 104/2 |
| 2015/0204741 | A1 | 7/2015 | Hagan | | |
| 2015/0211192 | A1 * | 7/2015 | Lichtberger | E01B 27/20 | 104/12 |
| 2017/0159244 | A1 * | 6/2017 | Lintz | E01B 27/17 | |
| 2018/0038051 | A1 * | 2/2018 | Vargas | E01B 33/02 | |
| 2019/0017226 | A1 * | 1/2019 | Auer | E01B 27/20 | |
| 2019/0271120 | A1 * | 9/2019 | Springer | E01B 27/17 | |

* cited by examiner

RAIL VEHICLE HAVING STABILIZER WORKHEAD WITH POWERED AXLES

CROSS-REFERENCE TO RELATED APPLICATIONS

This application claims priority to U.S. Provisional App. Ser. No. 62/371,508, filed on Aug. 5, 2016, which is hereby incorporated by reference in its entirety.

BACKGROUND

Railroads are generally constructed of a pair of elongated, substantially parallel rails, which are coupled to a plurality of laterally extending ties via metal tie plates and spikes and/or spring clip fasteners. The rails and ties are disposed on a ballast bed formed of hard particulate material, such as gravel. In many instances, including upon initial installation, the ties may not be disposed tightly within the ballast bed.

Stabilizers have been used to stabilize railroad ties into the ballast bed, while also testing the integrity of the rails and ties. Conventional stabilizers rely on hydraulic cylinders positioned on a frame to generate downward forces. The weight of the frame carrying such cylinders is generally more than the amount of force applied in the downward direction so that the frame will not lift off of the rail. This arrangement requires heavy, manned machinery, which adds to the inefficiency and cost of the stabilizing operation. Accordingly, lightweight stabilizers that may be deployed for applications requiring mobility and quick setups are needed.

BRIEF SUMMARY

The present disclosure generally relates to a track stabilizer for use in stabilizing railroad ties into ballast bed. The track stabilizer vehicle according to the present disclosure is lightweight, which allows the stabilizer vehicle to be deployed for applications where mobility and quick setups are required. To accommodate such applications, the stabilizer workhead includes powered axles, such that the axles assist with travel of the stabilizer vehicle along rails. Such an arrangement is particularly useful where the lightweight stabilizer vehicle must travel along challenging grades. The axles may be powered via a hydraulic motor operatively coupled to the wheel assembly. Related methods are described.

BRIEF DESCRIPTION OF THE DRAWINGS

Reference is now made to the following descriptions taken in conjunction with the accompanying drawings.

DETAILED DESCRIPTION

Various embodiments of a track stabilizer and methods of using a track stabilizer according to the present disclosure are described. It is to be understood, however, that the following explanation is merely exemplary in describing the devices and methods of the present disclosure. Accordingly, several modifications, changes and substitutions are contemplated.

Figure 1A:
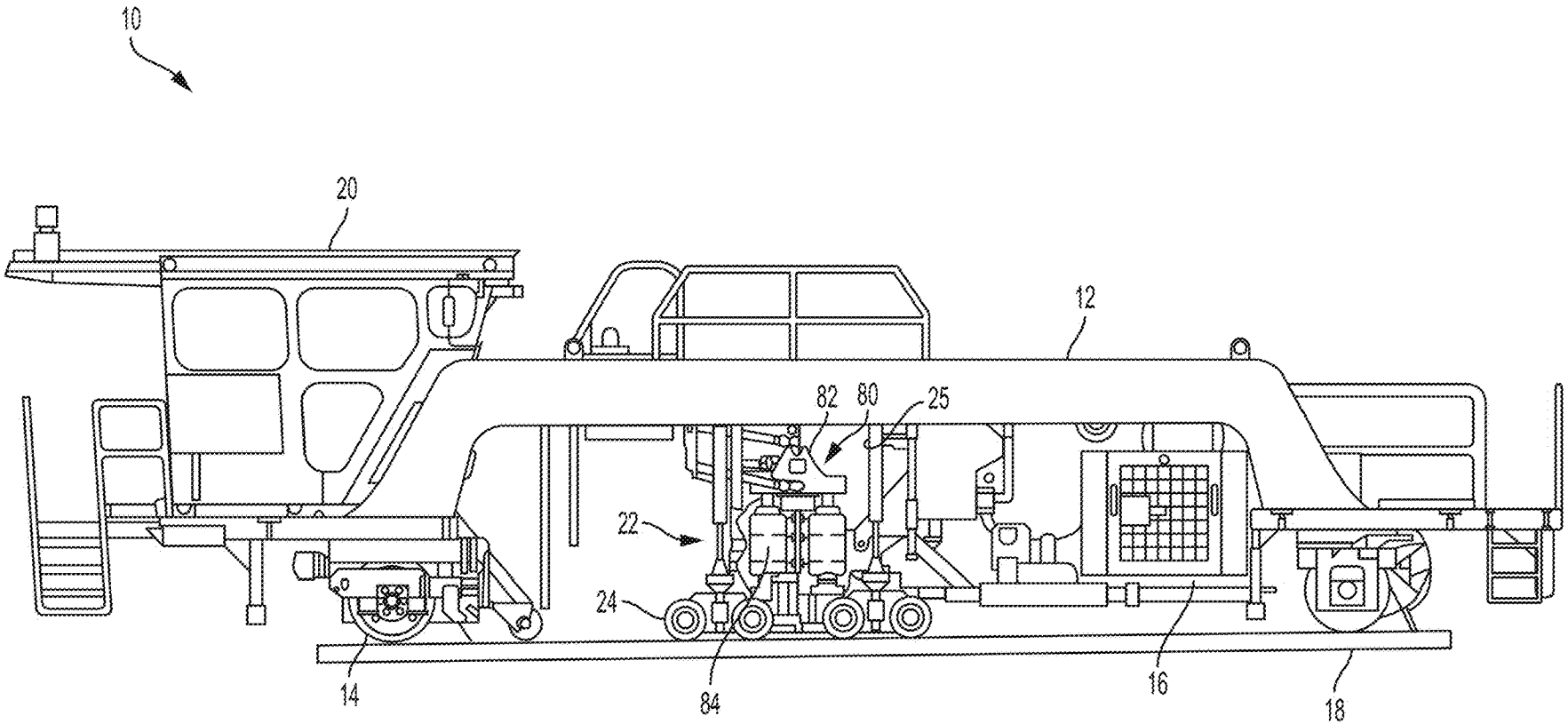
FIG. 1A illustrates a side view of a manned track stabilizer according to one embodiment of the present disclosure.

A rail vehicle having a track stabilization workhead unit according to the present disclosure is depicted as reference numeral 10 in FIG. 1A. The rail vehicle 10 includes a frame 12, which is operatively coupled to a plurality of rail wheels 14. The rail vehicle 10 further includes an engine 16 for propelling the rail vehicle along a track 18. An operator cabin 20 is disposed at a rearward end of the rail vehicle 10. A track stabilization workhead unit 22 is operatively coupled to the frame 12 and depends downwardly therefrom. The track stabilization workhead unit 22 may include a plurality of wheels 24, which operatively engage the track 18 to allow for movement of the track stabilization workhead unit along the track when in operation. In one embodiment, the track stabilization workhead unit 22 includes eight wheels 24.

The track stabilization workhead unit 22 may be lowered into contact with the track 18 via a pair of hydraulic cylinders 25 disposed between the frame 12 and the workhead unit. In this manner, the track stabilization workhead unit 22 may have two positions—a first, raised position where the workhead unit is not deployed, and a second, lowered position where the workhead unit is engaged with the track 18 and is operable to perform track stabilization operations. The hydraulic cylinders 25 also function to apply downward force on the track stabilization workhead unit 22 as will be described.

Figure 1B:
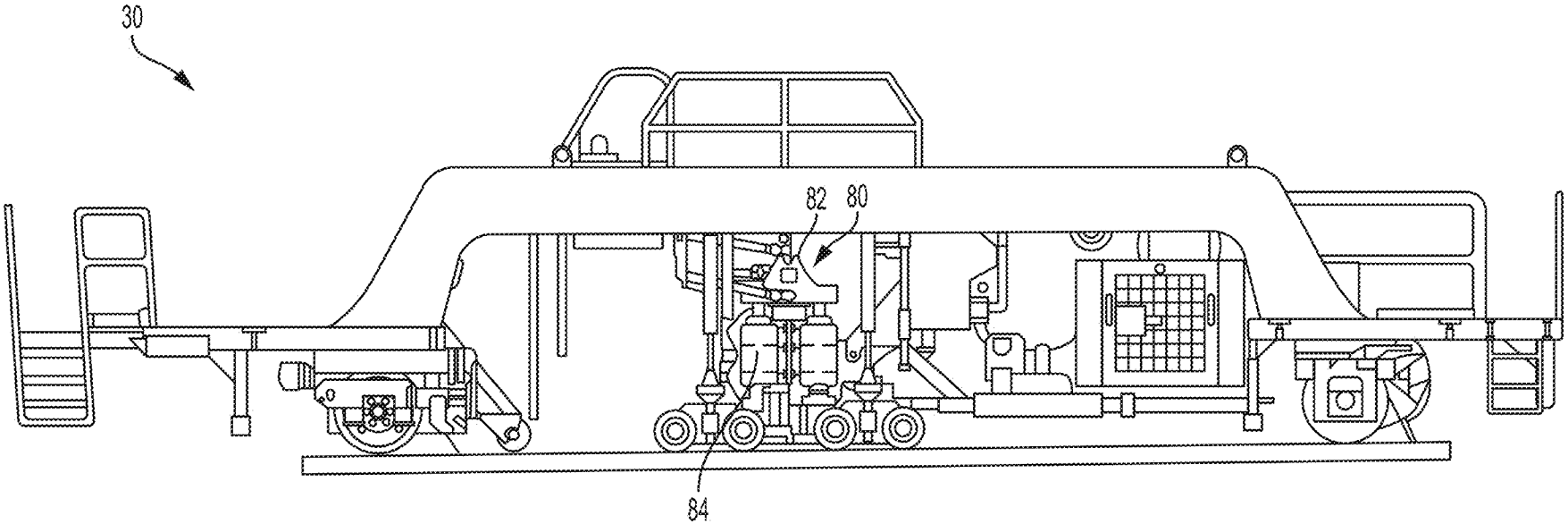
FIG. 1B illustrates a side view of a drone track stabilizer according to another embodiment of the present disclosure.

Referring to FIG. 1B, an alternative rail vehicle having a track stabilization workhead unit according to the present disclosure is depicted as reference numeral 30. In this embodiment, the rail vehicle 30 takes the form of a drone vehicle that may be remotely operated. In this manner, the operator cabin of the embodiment of FIG. 1A is removed, thus reducing the size and weight of the rail vehicle 30. The drone rail vehicle 30 may be operated from another rail vehicle or via operators at a remote location, such as a control center.

Figure 2A:
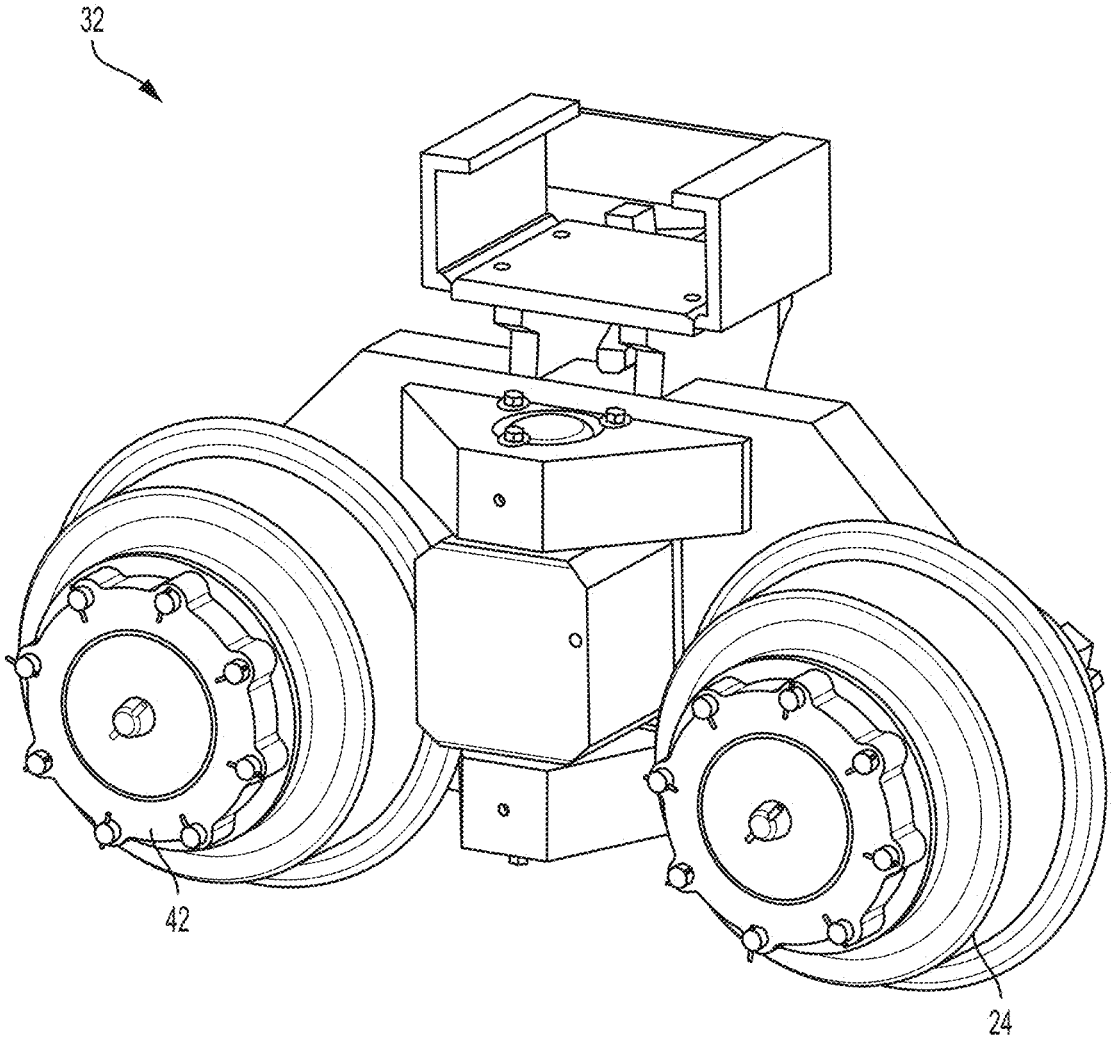
FIG. 2A illustrates a front perspective view of a wheel assembly for a track stabilizer according to the present disclosure.
Figure 2B:
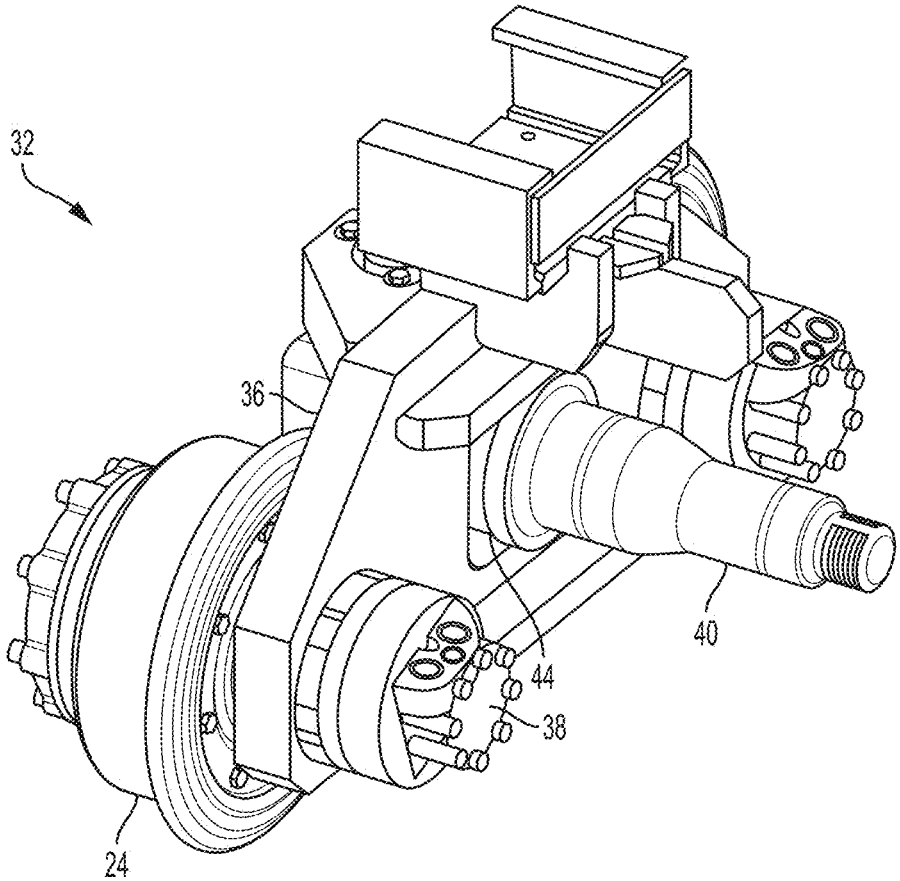
FIG. 2B illustrates a rear perspective view of the wheel assembly of FIG. 2A.
Figure 4:
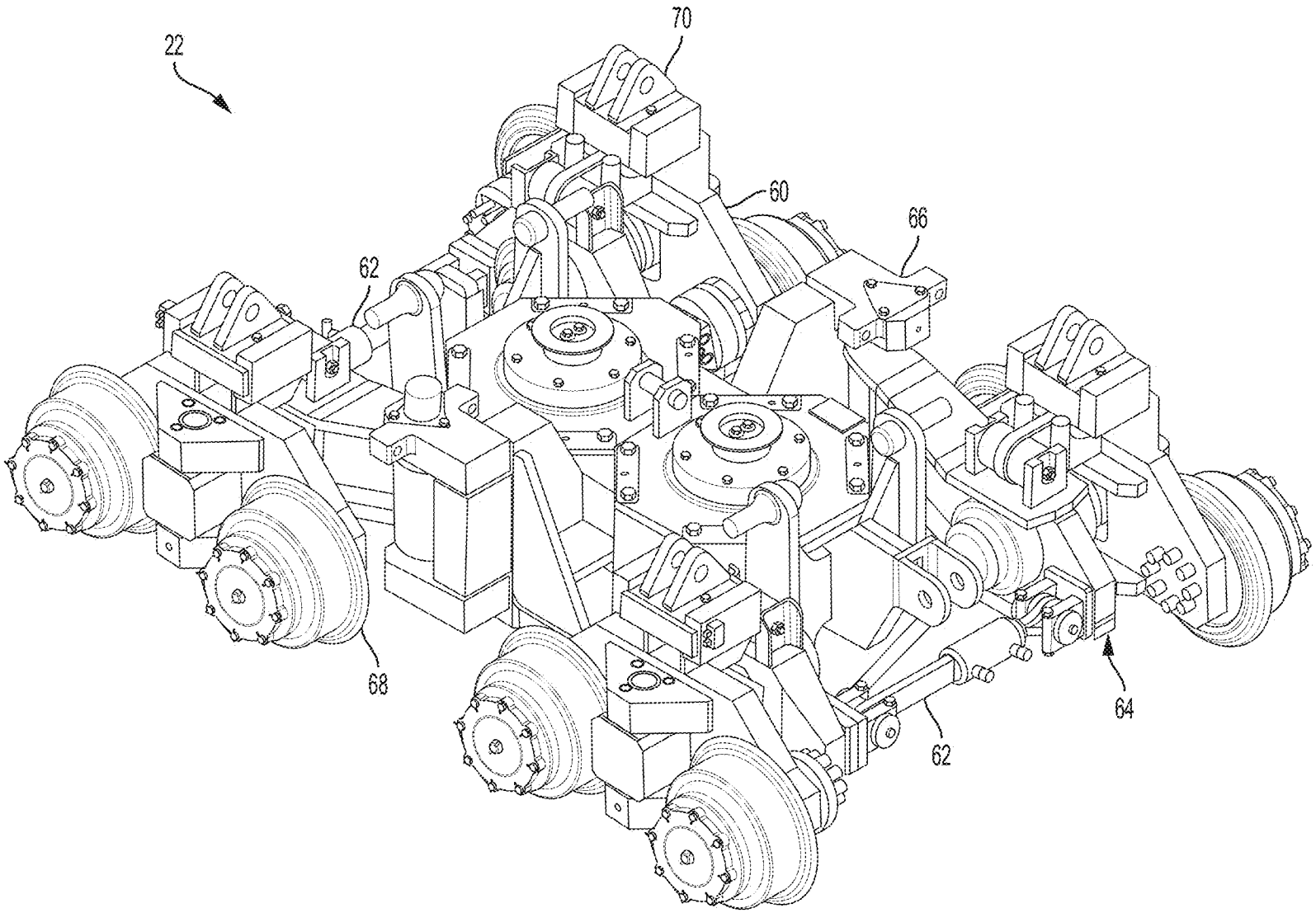
FIG. 4 illustrates a perspective view of a track stabilization workhead unit according to the principles of the present disclosure.
Figure 5:
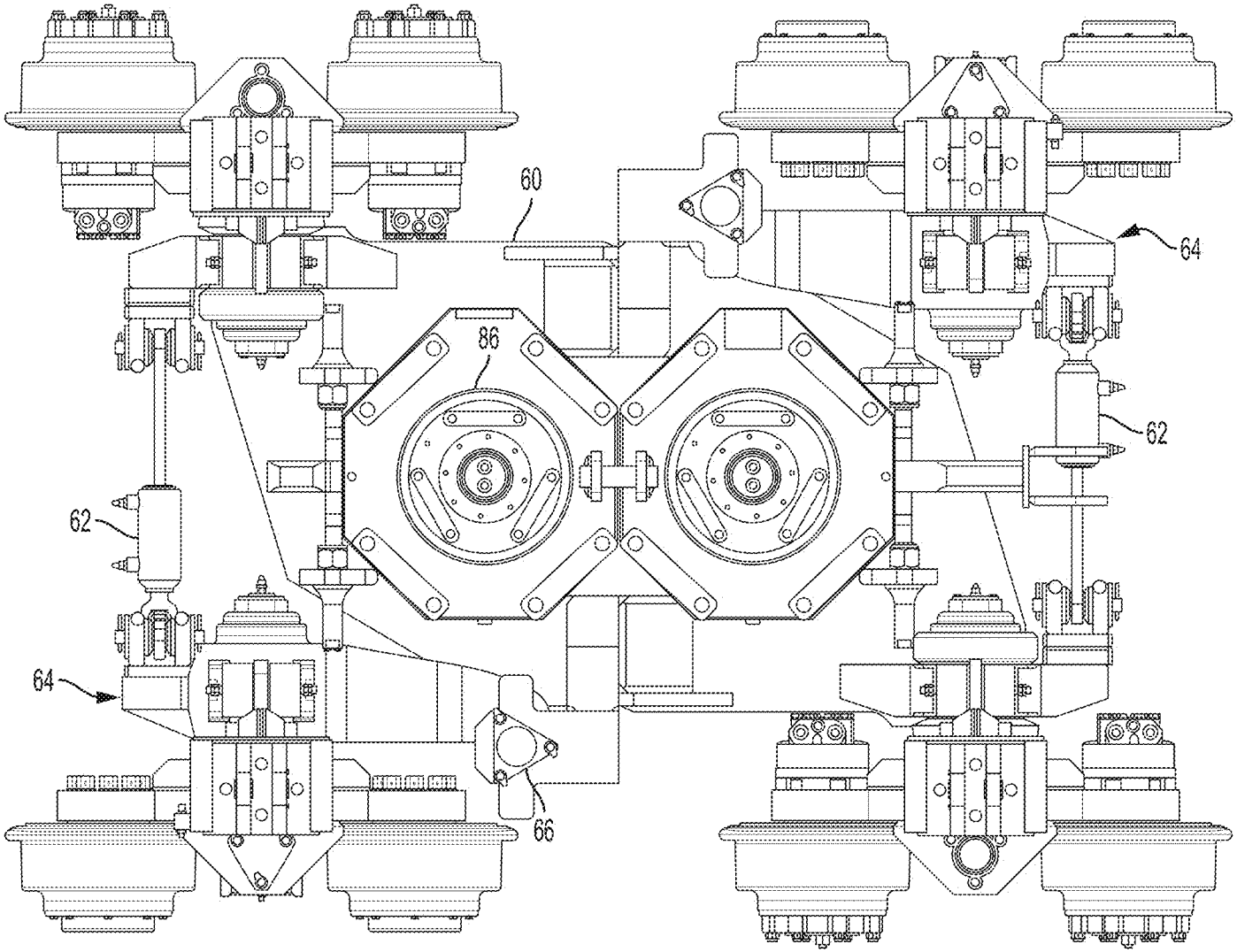
FIG. 5 illustrates a top view of the track stabilization unit of FIG. 4.

The track stabilization workhead unit 22 includes a plurality of wheel assemblies 32, one of which is depicted in FIGS. 2A and 2B. The wheel assembly 32 includes a pair of rail wheels 24 for moving along the track 18 when engaged therewith. The wheel assembly 32 further includes a frame member 36, which is disposed between the rail wheels 24 and corresponding motors 38 that power assist the rail wheels as will be described. In some embodiments, the motors 38 are hydraulic motors and are only deployed on two wheels 24 on each side of the track stabilization workhead unit 22 as depicted in FIGS. 4 and 5. The wheel assembly 32 further includes a rod member 40 that operatively couples the wheel assembly to the track stabilization unit 22. The rod member 40 has a flange member 42 disposed on the wheel side of the frame member 36 for securing the rod member to the wheel assembly 32. The rod member 40 extends through the frame member 36 and includes a connecting portion 44 for connecting to the track stabilization unit 22.

Figure 3:
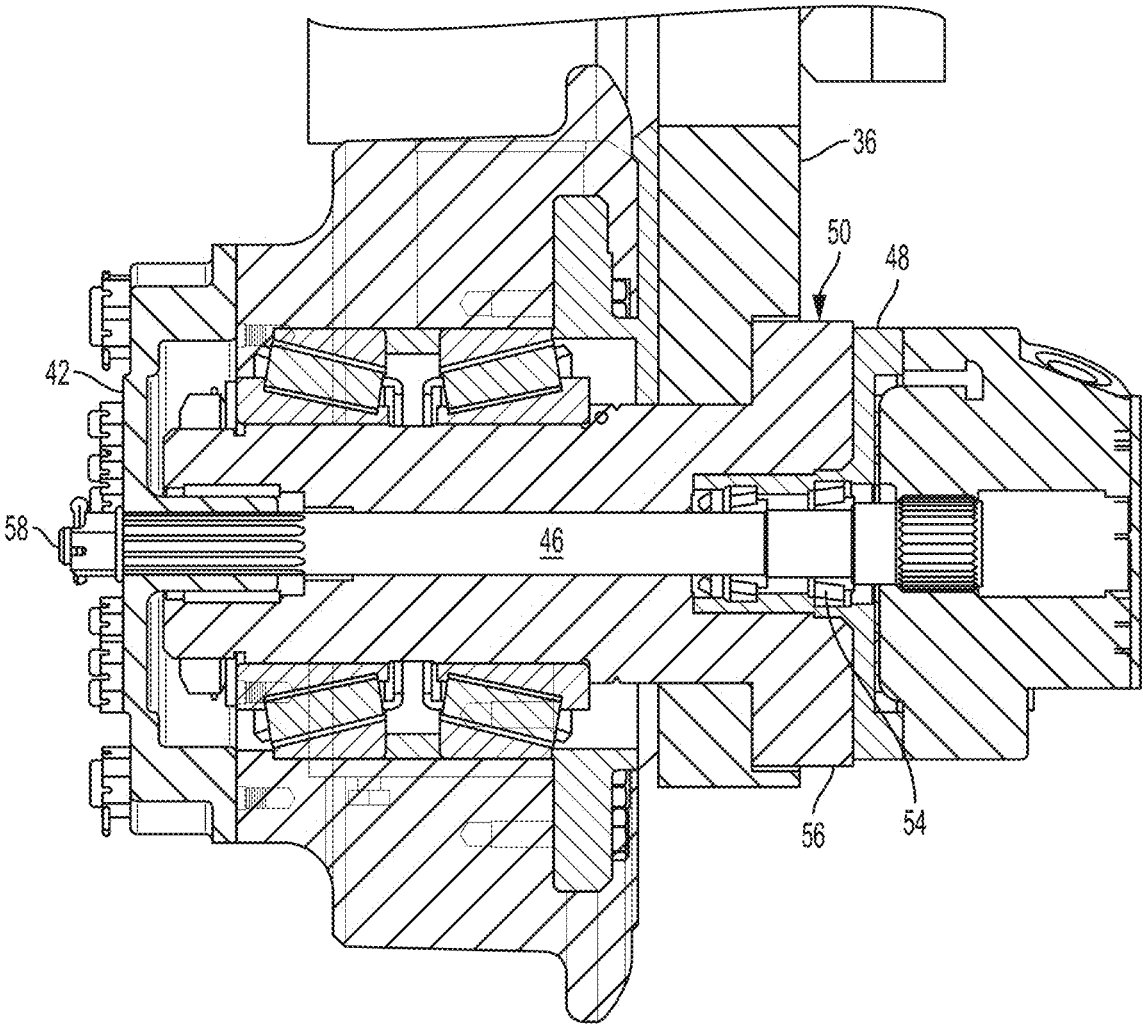
FIG. 3 illustrates a top sectional view of the wheel assembly of FIG. 2A.

Referring FIGS. 2A, 2B and 3, the motor 38 is operatively coupled to a drive shaft or axle 46, which extends from the motor, through a bearing housing 48, a stub axle 50 and the drive flange 42, to drive the corresponding rail wheel 24. In that regard, the motor 38 is disposed adjacent to the bearing housing 48, which includes bearings 54 for facilitating rotation of the drive shaft 46 when in operation. The stub axle 50 is disposed through the frame member 36 and includes a flange member 56 that abuts the frame member and the bearing housing 48. At its distal end, the stub axle 50 is coupled to the drive flange 42. A locking nut 58 is provided to lock the drive shaft 46 in place such that rotation of the drive shaft imparts rotation to the rail wheel 24. In this manner, the motor 38 provides a power assist to operation of the rail wheel 24 by imparting rotation to the drive shaft 46.

Referring to FIGS. 4 and 5, the track stabilization workhead unit 22 includes a base 60 with a pair of bias cylinders 62 disposed at opposite ends of the workhead unit. The bias cylinders 62 are fixedly coupled to the base 60 at one end and are movably coupled to a bias arm 64 at its opposite end. The bias arm 64, in turn, is hingedly coupled to the base 60 via a locking plate 66. In one embodiment, the locking plate 66 is a triangular locking plate. The bias cylinders 62 and bias arms 64 cooperate to apply a lateral force on the rail wheels 24 such that the rail wheels rest against the face of the rail. In this regard, the rail wheels 24 include a lip portion 68 that is forced against the face of the rail to bias the track stabilization workhead unit 22 against the rails during stabilization operations. The lateral force applied against the rails stabilizes the track stabilization workhead unit 22 in the lateral direction.

The hydraulic cylinders 25 (FIG. 1) extend vertically and couple to the track stabilization workhead unit 22 at corresponding lugs 70, which are disposed on the frame members 36 of the wheel assemblies 32. In this manner, actuation of the hydraulic cylinders 25 applies a downward stabilization force into the track stabilization workhead unit 22, and therefore the rails of the track 18.

While the hydraulic cylinders 25 are configured to apply a downward stabilization force, the track stabilization workhead unit 22 is also configured to apply a lateral stabilization force. Referring again to FIG. 1 and also to FIGS. 4 and 5, the rail vehicle 10 further includes a workhead 80 for imparting lateral forces on the track stabilization workhead unit 22. The workhead 80 includes a motor and gearbox 82, which includes gears on each side of the motor. The gears drive and rotate downwardly extending shafts (encased in shaft holders 84), which are coupled to the track stabilization workhead unit 22 at flywheels 86 disposed on the workhead unit. In one embodiment, the flywheels 86 are disposed on octagonal plates coupled to the base 60 of the track stabilization workhead unit 22. The flywheels 86 are weight-imbalanced and are rotated in opposite directions to impart vibrations in the horizontal plane. That is, rotation of the flywheels 86 causes lateral forces to be applied to the track 18 via the force applied by the track stabilization workhead unit 22 to the rail wheels 24 via the lip portions 68.

In operation, the rail vehicle 10 may travel to a portion of track 18 where track stabilization operations are desired. At this time, the track stabilization workhead unit 22 may be lowered into contact with the track 18 via the hydraulic cylinders 25. The hydraulic cylinders 25 are then further actuated to apply a downward force to the track stabilization workhead unit 22, thereby stabilizing the track 18 in the vertical direction. At the same time, the track 18 may be stabilized laterally through the application of lateral forces against the track. As such, the motor may be actuated to impart rotation to the gears and therefore the shafts that couple to the flywheels 86. In this manner, the track 18 is stabilized through the application of vertical and lateral forces against the track via the track workhead stabilization unit 22.

The rail vehicle 10 may travel along the rails during application of the stabilization forces. During this movement, the hydraulic motors 38 power assist the drive shaft 46 of the rail wheel 24, thus providing a tractive force that assists movement of the rail vehicle 10 along the rails. Prior art track stabilization devices are heavy and difficult to operate in certain conditions, such as over high grade elevations, thus causing the track stabilization unit to drag and operations to slow down. Due to the lightweight nature of the track stabilization workhead unit 22 enabled by the provision of the hydraulic motors 38, the workhead unit of the present disclosure more easily traverses track having an elevated grade. The powered axles of the present disclosure also reduces the amount of downward force that needs to be applied given that the track stabilization workhead unit 22 is lighter than prior art units.

While various embodiments in accordance with the disclosed principles have been described above, it should be understood that they have been presented by way of example only, and are not limiting. For example, while hydraulic motors 38 are described as being coupled to the wheel assembly through a drive shaft arrangement, other coupling arrangements are contemplated, such as chain and sprocket assemblies. Further, while the depicted embodiment shows two hydraulic motors on each side of the track stabilization workhead unit 22, it is to be appreciated that additional hydraulic motors 38 may be used, or less hydraulic motors may be used, depending on the requirements of the stabilization operations. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

What is claimed is:

1. A track stabilization unit, comprising:
- a base;
- a one or more wheel assemblies coupled to the base, at least one wheel assembly comprising:
  - a frame member;
  - a plurality of wheels coupled to a first side of the frame member, the wheels configured to bias against rails of a railroad track; and
  - a plurality of motors coupled to a second side of the frame member, each motor coupled to a respective wheel of the plurality of wheels via a drive shaft that extends through the frame member such that rotation of the drive shaft drives rotation of the wheel.

2. The track stabilization unit of claim 1, wherein the base is coupled to a rail vehicle, the rail vehicle being configured to travel along rails of a railroad track.

3. The track stabilization unit of claim 2, wherein the rail vehicle includes a frame and a plurality of vertical hydraulic cylinders coupled to the base and configured to impart a downward force on the base.

4. The track stabilization unit of claim 3, wherein the base comprises one or more flywheels, each flywheel coupled to a respective hydraulic cylinder of the respective hydraulic cylinders.

5. The track stabilization unit of claim 1, wherein:

the at least one wheel assembly includes a first motor of the plurality of motors that is coupled to a first wheel of the plurality of wheels, the at least one wheel assembly comprises a bearing housing interposed between the second side of the frame member and the first motor; and the drive shaft extends through the bearing housing.

6. The track stabilization unit of claim 5, wherein the at least one wheel assembly further comprises a stub axle coupled to the bearing housing and surrounding the drive shaft, the stub axle extending through the frame member.

7. The track stabilization unit of claim 6, wherein the at least one wheel assembly further comprises a drive flange coupled to the stub axle and the first wheel.

8. The track stabilization unit of claim 1, further comprising:

a biasing arm coupled to each of the one or more wheel assemblies, each biasing arm coupled to the base; and a bias cylinder disposed between a pair of wheel assemblies;

wherein:

a first end of the bias cylinder is coupled to the biasing arm of a first wheel assembly of the pair of wheel assemblies; and a second end of the bias cylinder is coupled to the biasing arm of a second wheel assembly of the pair of wheel assemblies.

9. The track stabilization unit of claim 2, wherein the rail vehicle comprises a drone vehicle.

10. A rail vehicle, comprising:

a frame;

a track stabilization unit coupled to the frame, the track stabilization unit comprising:

a base;

a plurality of first wheel assemblies coupled to the base, each first wheel assembly comprising:

a frame member;

a plurality of wheels coupled to a first side of the frame member, the wheels configured to bias against rails of a railroad track; and a plurality of motors coupled to a second side of the frame member, each motor coupled to a respective wheel of the plurality of wheels via a drive shaft that extends through the frame member such that rotation of the drive shaft drives rotation of the wheel.

11. The rail vehicle of claim 10, wherein the rail vehicle includes a plurality of vertical hydraulic cylinders coupled between the frame and the track stabilization unit.

12. The rail vehicle of claim 11, wherein at least one first wheel assembly of the plurality of first wheel assemblies is coupled to a first side of the base and at least one other first wheel assembly of the plurality of first wheel assemblies is coupled to a second side of the base, the second side of the base opposing the first side of the base.

13. The rail vehicle of claim 10, wherein each first wheel assembly comprises a bearing housing coupled to each motor of the plurality of motors, each bearing housing surrounding the drive shaft.

14. The rail vehicle of claim 13, wherein each first wheel assembly further comprises a stub axle surrounding the drive shaft, the stub axle extending from a first end, coupled to the bearing housing, through the frame member to a second end.

15. The rail vehicle of claim 14, wherein each first wheel assembly further comprises a drive flange coupled to the second end of the stub axle.

16. The rail vehicle of claim 10, further comprising:

a bias cylinder disposed between a one first wheel assembly of the plurality of first wheel assemblies and a second wheel assembly that is disposed on an opposing side of the base as the one first wheel assembly.

17. The rail vehicle of claim 10, wherein the rail vehicle comprises a drone vehicle.

18. A method for stabilizing railroad track, comprising:

moving a track stabilization unit relative to a frame of a rail vehicle, the track stabilization unit having a base and a plurality of first wheel assemblies coupled to the base, each first wheel assembly comprising a frame member, a plurality of wheels coupled to a first side of the frame member, and a plurality of motors coupled to a second side of the frame member, each motor coupled to a respective wheel of the plurality of wheels via a drive shaft that extends through the frame member;

applying downward force to the track stabilization unit via a plurality of hydraulic cylinders extending between the frame and the track stabilization unit; and rotating, via the plurality of motors, the plurality of wheels of each of the first wheel assemblies to provide power assist to the track stabilization unit when traveling along the railroad track.

19. The method of claim 18, wherein the power assist is provided during operation of the track stabilization unit over high grade railroad track.

20. The method of claim 18, further comprising lifting the track stabilization unit off of the railroad track via the hydraulic cylinders.

* * * * *